United States Patent [19]

Vuissoz

[11] 4,275,704

[45] Jun. 30, 1981

[54] APPARATUS FOR CENTRAL HEATING

[76] Inventor: Constant Vuissoz, 3941 Grone, Suisse, Switzerland

[21] Appl. No.: 963,347

[22] Filed: Nov. 24, 1978

[30] Foreign Application Priority Data

Dec. 16, 1977 [CH] Switzerland ..... 15490/77

[51] Int. Cl.[3] ..... F24C 3/04; F24H 1/20

[52] U.S. Cl. ..... 126/92 R; 126/92 AC; 126/360 R; 122/367 C; 122/367 R; 431/347; 431/352

[58] Field of Search ..... 122/367 R, 367 C; 431/347, 171, 352; 126/92 R, 92 AC, 92 C, 92 A, 350, 360

[56] References Cited

U.S. PATENT DOCUMENTS

| | | | |
|---|---|---|---|
| 1,668,612 | 5/1928 | Slattery | 126/92 AC |
| 1,683,375 | 9/1928 | Wiederhold | 126/92 AC |
| 1,699,789 | 1/1929 | Hartford | 126/92 AC |
| 2,677,366 | 5/1954 | Wayatt | 126/92 AC |
| 2,822,799 | 2/1958 | Sterick | 126/92 R |
| 3,007,457 | 11/1961 | Ospelt | 122/367 R |
| 3,171,388 | 3/1965 | Ganz | 122/367 R |
| 3,187,741 | 6/1965 | Oatley | 126/92 AC |
| 3,260,255 | 7/1966 | Oatley | 126/92 AC |
| 3,291,189 | 12/1966 | Schade, Jr. | 431/347 |
| 3,713,433 | 1/1973 | Grainger | 431/352 |
| 3,756,202 | 9/1973 | Keith | 122/367 R |
| 4,012,189 | 3/1977 | Vogt et al. | 431/352 |
| 4,055,152 | 10/1977 | Vidaleng | 122/367 C |
| 4,141,213 | 2/1979 | Ross | 431/352 |
| 4,169,431 | 10/1979 | Viessmann | 122/367 C |
| 4,187,835 | 2/1980 | Finney | 126/360 R |

*Primary Examiner*—Henry C. Yuen

*Attorney, Agent, or Firm*—Robert E. Burns; Emmanuel J. Lobato; Bruce L. Adams

[57] ABSTRACT

A structure placed in the fire-box of a furnace to improve combustion comprises a plurality of stainless steel strips which are supported on a frame in position to be heated to incandescence by the flame of the burner. At least some of the strips are twisted in corkscrew manner. In one embodiment, twisted strips alternating with untwisted strips are hung on a cross piece of the frame on the side facing the burner. A perforated metal sheet is mounted on the back side of the frame. In another embodiment horizontally extending twisted strips are supported between spaced inner and outer arched supports which extend up from runners resting on the floor of the fire-box. A perforated metal sheet is applied over the outside of the outer supports.

6 Claims, 13 Drawing Figures

Fig. 2
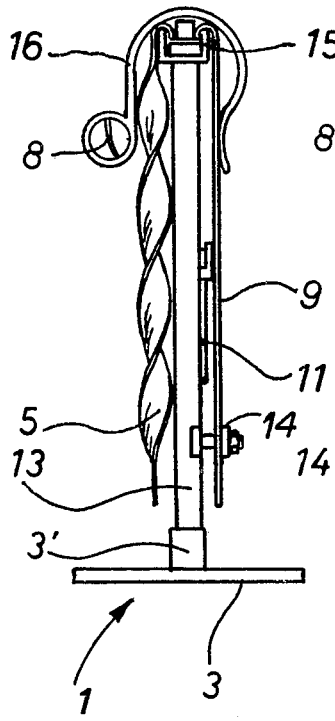
Fig. 1
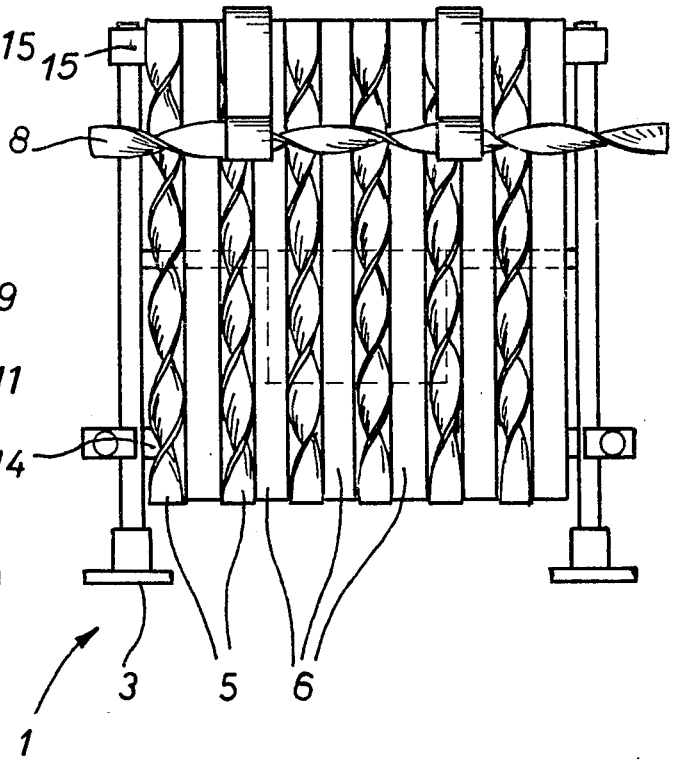
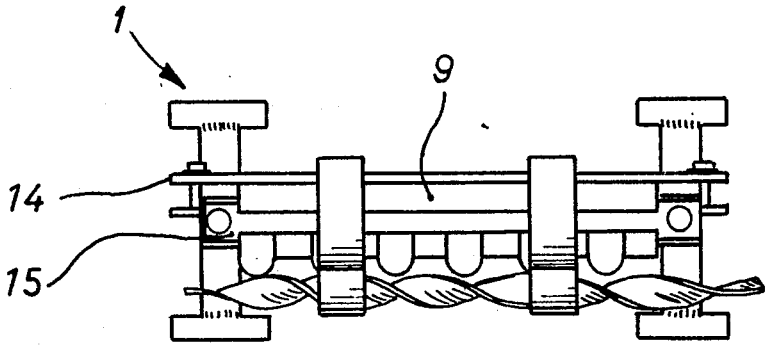
Fig. 3

Fig.6 coupe A–A
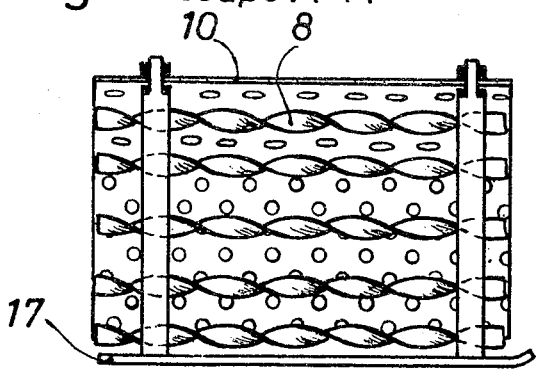
Fig.7
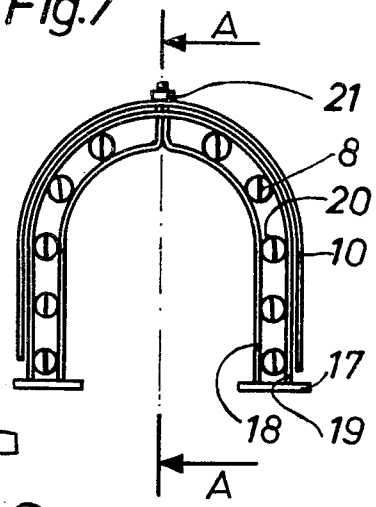
Fig.10
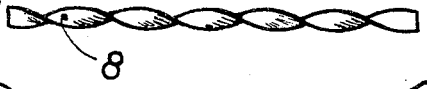
Fig. 9
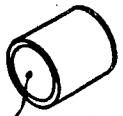
Fig. 12
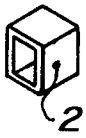
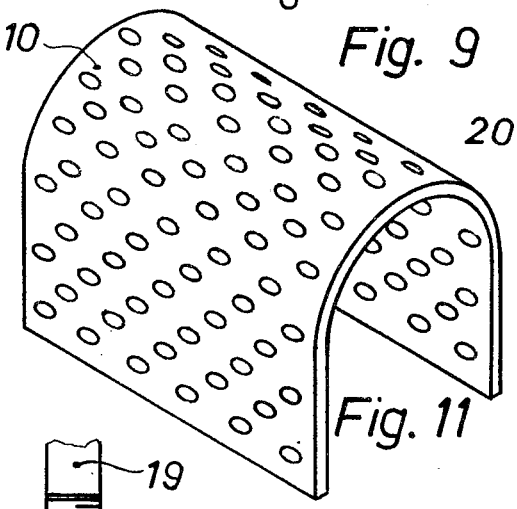
Fig. 11
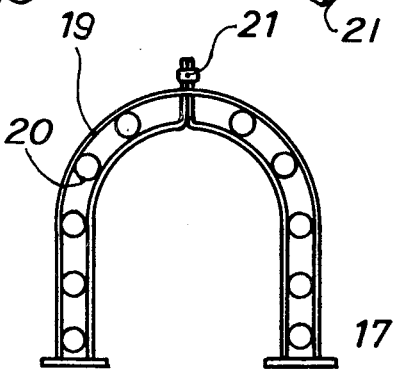
Fig. 8
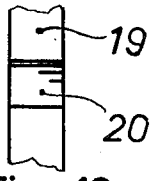
Fig. 13
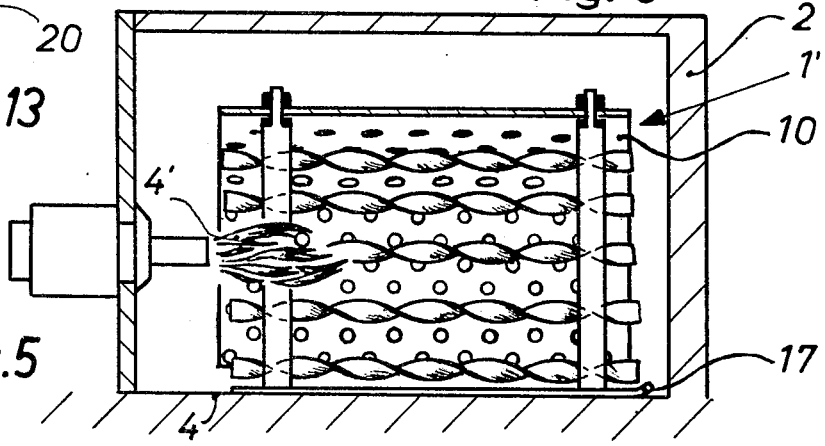
Fig.5

APPARATUS FOR CENTRAL HEATING

BACKGROUND OF THE INVENTION

The present invention relates to an apparatus for central heating, for space heating and the preparation of hot water, comprising a boiler and an oil burner the flames of which are directed horizontally with, arranged between the burner and the walls of the boiler, a structure which, being brought to incandescence is intended to improve combustion and by virtue of this to reduce smoke and soot deposits in the fire-box.

Such pieces of apparatus are known, and are described in Patent applications Nos. 16661/75 and 76 38795 of the present inventor. The structures described are particularly suitable for low and medium power boilers, providing less than 100,000 Kcal/h.

SUMMARY OF THE INVENTION

There is however also demand for such structures, which are suitable for use with very large boilers of 200,000 Kcal/h and above. It is the aim of the present invention to provide a heating apparatus which is characterized by the fact that the said structure is detachable, that it is composed of parts which can be assembled together at will and which are connected by fixing means to a support whose base rests on the floor of the fire-box, the whole assembly being arranged in such a manner as to allow for adaptation of the structure to boilers of various dimensions.

DESCRIPTION OF DRAWINGS

The attached drawing, which is given by way of non-limiting example, shows two embodiments of the present invention.

FIGS. 1 to 4 show a first embodiment; FIG. 1 is a front view, FIG. 2 is a side view, FIG. 3 is a plan view and FIG. 4 is an exploded view of the various parts.

FIGS. 5 to 12 show a second embodiment: FIG. 5 is a section through the boiler on the axis of the burner; FIG. 6 is a side view of the said structure mounted on its support; FIG. 7 is a front view; FIGS. 8 to 13 show various individual parts.

DESCRIPTION OF PREFERRED EMBODIMENTS

Figure 4:
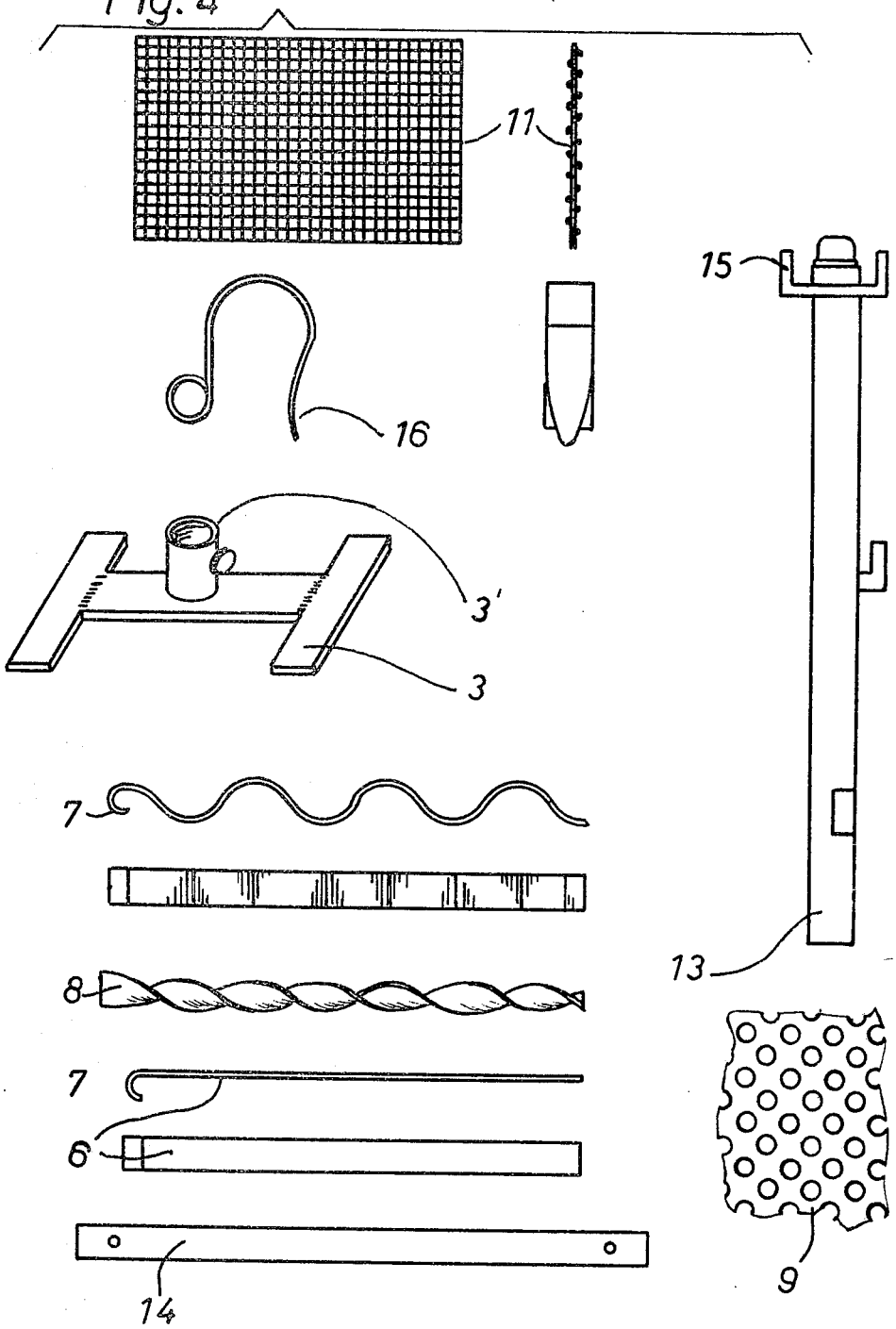

Reference will now be made to FIGS. 1 to 4 which show the construction of a first embodiment. 1 numeral 1 designates the structure in accordance with the invention which is assembled to two bases 3 via the intermediary of vertical supports 13 which fit in sockets 31 on the bases 3 and are joined by horizontal cross pieces 14 and 15. On the frame which is made up by the cross pieces 14 and 15 and the uprights 13, which are fixed at an adjustable height on the two bases 3, there are hung on each side and in a side-by-side relationship, strips of stainless steel 5, which are twisted in the shape of a corkscrew and, which alternate with non-twisted strips 6. These strips are bent over in the form of a hook 7 at their upper end, and hooked on to the upper cross piece 15, which has a U-section. On one side of the said frame, the strips 5 and 6 can be replaced by a perforated metal sheet 9. Towards the middle of sheet 9, facing the burner, a perforated metal sheet 11 is arranged. A strip 8 which is twisted in the shape of a corkscrew is arranged horizontally in loops 16' of two hooks 16 which are hooked over the upper cross piece 15.

FIGS. 5 to 13 show another embodiment, which is particularly adapted for use with larger fire-boxes.

FIG. 5 shows a section through the fire-box 2 along the axis of the flame 4'. There can be seen the structure 1' which is also shown in FIGS. 6 and 7. The structure 1' is supported on the floor 4 of the fire-box by a base comprising two arms 17, whose ends 17' are curved upwardly in the shape of a sledge runner. The interior 18 and exterior 19 uprights are welded on to the two bases 17 and clamp bushes 20 into position which have the purpose of guiding the stainless steel strips which are twisted in the shape of a corkscrew 8.

FIG. 8 shows the assembly of the exterior upright 19 and the interior upright 18 which is in two parts joined together at their peak by a joining ring 21.

Along the length of the structure three groups of uprights 18, 19 are distributed and a perforated sheet 10 is applied over the latter, as is shown in FIG. 7.

FIGS. 9 to 13 show various parts of the structure. Thus FIG. 9 shows one of the bushes 20, FIG. 10 shows one of the twisted strips 8, FIG. 11 shows the perforated sheet 10, FIG. 12 shows a ring 21 for joining the two parts of the uprights 18, 19 and FIG. 13 shows how one of the bushes 20 is welded on to upright 19.

The perforated sheet metal part 10 can be made in two or three parts depending on the passage which is made available by the door of the fire-box.

The structure according to the present invention is placed in the fire-box of the boiler after the refractory bricks have been removed.

Should this be necessary, it is possible to leave some bricks on the floor of the boiler in order to make up height, and centre the structure with respect to the flame.

This structure makes it possible to transform the normal boiler flame into a bluish flame, which is much hotter for having passed through a permanent intense source of heat before reaching heat exchange surfaces of the boiler containing the water for circulation to the radiators. This flame, which is hotter than the normal flame, activates circulation of the hot water and prevents any possibility of pollution, since it burns all the constituents of the oil and prevents any fouling of the boiler, of the burner and of the chimney, even if the fuel oil is of secondary quality.

It is not necessary for there to be refractory bricks between the wall of the boiler and the apparatus, which have the purpose of insulating the boiler and of sending heat back to the burner in order to prevent sooting up of the latter. The presence of the structure which has been described is sufficient to prevent sooting up of the burner and there is no danger whatsoever to the boiler from the superheated flame from the apparatus, since it contains water which is rapidly renewed, depending on the intensity of heating.

I claim:

1. In combination with a furnace comprising a fire-box constituting a combustion chamber having floor, and heat exchange surfaces having one face exposed to combustion gases and an opposite face exposed to a fluid to be heated, and a fuel oil burner the flame of which is directed horizontally into said fire-box, means for improving combustion comprising support means in said fire-box and a plurality of juxtaposed elements which are supported by said support means inside said fire-box spaced from said heat exchange surfaces and in the path of said flame, said support means comprising spaced uprights having bases resting on the floor of said fire-box and cross-pieces extending between and connecting said uprights, and said elements comprising strips of stainless steel at least some of which are twisted, said strips being individually supported by said support means in position to be completely surrounded by combustion gases and to be heated to incandescence by said flame.

2. A combination according to claim 1, in which said strips are formed at their upper ends with hooks which hook over an upper one of said cross-pieces.

3. A combination according to claim 2, in which said cross-pieces are fixed at an adjustable height relative to said bases.

4. A combination according to claim 1, in which said strips are provided on the side of said support means facing the burner and a perforated metal sheet is mounted on the opposite side of said support means.

5. A combination according to claim 1, in which said strips extend vertically on the side of said support means facing the burner and in which a twisted stainless steel strip extends horizontally in front of said vertically extending strips and is supported at spaced points along its length.

6. A combination according to claim 1, in which said twisted strips alternate with untwisted strips.

* * * * *